US006386165B1

(12) United States Patent
Eisenmann et al.

(10) Patent No.: US 6,386,165 B1
(45) Date of Patent: May 14, 2002

(54) DEVICE FOR ADJUSTING THE PHASE POSITION OF A SHAFT

(75) Inventors: Siegfried Eisenmann; Hermann Harle, both of Aulendorf (DE)

(73) Assignee: Trochocentric International AG, Jona-Rapperswil (CH)

( * ) Notice: Subject to any disclaimer, the term of this patent is extended or adjusted under 35 U.S.C. 154(b) by 0 days.

(21) Appl. No.: 09/700,085

(22) PCT Filed: May 12, 1998

(86) PCT No.: PCT/EP98/02759

§ 371 Date: Jan. 4, 2001

§ 102(e) Date: Jan. 4, 2001

(87) PCT Pub. No.: WO99/58821

PCT Pub. Date: Nov. 18, 1999

(51) Int. Cl.[7] ..... F01L 1/34

(52) U.S. Cl. ..... 123/90.17; 123/90.31; 464/2; 464/161

(58) Field of Search ..... 123/90.15, 90.17, 123/90.31, 90.12, 90.6; 74/568 R; 464/1, 2, 160, 161

(56) References Cited

U.S. PATENT DOCUMENTS 5,056,477 A * 10/1991 Linder et al. ..... 123/90.17
5,189,999 A * 3/1993 Thoma ..... 123/90.17
5,293,845 A * 3/1994 Yamazaki et al. ..... 123/90.17
5,386,807 A * 2/1995 Linder ..... 123/90.17
5,450,825 A * 9/1995 Geyer et al. ..... 123/90.17
5,507,254 A * 4/1996 Melchior ..... 123/90.17
5,645,017 A * 7/1997 Melchior ..... 464/2
5,649,506 A * 7/1997 Melchior ..... 123/90.17
5,794,578 A * 8/1998 Strauss et al. ..... 123/90.17
6,129,061 A * 10/2000 Okuda et al. ..... 123/90.17
6,138,623 A * 10/2000 Heer ..... 464/2
6,267,089 B1 * 7/2001 Golovatai-Schmidt ... 123/90.17

* cited by examiner

*Primary Examiner*—Teresa Walberg
*Assistant Examiner*—Fadi H. Dahbour
(74) *Attorney, Agent, or Firm*—Rothwell, Figg, Ernst Manbeck

(57) ABSTRACT

The device for adjusting the phase position of a shaft, especially a camshaft that can be rotated by a drive shaft, more particularly a crankshaft, by a transmission device with at least one transmission wheel, is configured as a rotary piston machine according to the orbit principle. The inventive device adjusts the rotary position of the transmission wheel in relation to the shaft. The rotary pistol machine includes a stator with inner teeth, an annular rotary piston with outer teeth that engage with the inner teeth of the stator, a driven part that can be rotated by the rotary piston and a valve that can be rotated by the rotary piston and a valve device. In order to control the movement of the rotary piston, the valve device enables rotating partial areas of the working area between the stator and the rotary piston to be joined to a fluid supply device at high or low pressure. The fluid supply device includes a control mechanism, a phase position detector and at least one control valve. It enables a theoretical phase position to be adjusted by actuating the valve in a corresponding manner. Fluidic connection to be adjustment device occurs by two angular rotational connections.

13 Claims, 3 Drawing Sheets

DEVICE FOR ADJUSTING THE PHASE POSITION OF A SHAFT

BACKGROUND OF THE INVENTION

The invention relates to an adjusting device for adjusting the phase position of a shaft, especially a camshaft.

The valves of internal combustion engines, in particular reciprocating internal combustion engines, are actuated by means of camshafts. The camshafts are caused to rotate by a drive shaft or by the crankshaft, via a transmission device. To be able to adapt the opening and closing times of valves to the respective current power output and/or speed of the engine, transmission devices having adjusters for adjusting the phase position of the rotary orientation of the camshafts are used. Such adjusters enable the control times of the intake and/or outlet valves to be influenced according to requirements, so that in particular the so-called overlap of the valve lift curves can be altered. At present, the use of these adjusters for the angle of rotation in the case of the camshafts of the intake valves is preferred. Increasingly, however, the camshafts of the outlet valves are also being rotationally adjusted.

The adjuster is preferably located between the camshaft wheel driven by a chain or a toothed belt and the camshaft. Depending on the respective transmission device, however, another arrangement of the adjuster, for example between the drive shaft and the drive shaft wheel, would also be possible. The relative rotational position between the camshaft wheel and the camshaft can be varied in a predetermined angular range. Preferably, a camshaft rotational range of only 0° to 30° is sufficient. In the case of four-cycle engines, in which the camshaft rotates at half the speed of the crankshaft, this range corresponds to a crankshaft rotational range of 0° to 60°. If both camshafts are simultaneously adjustable, the term doubly variable camshaft control is used. It produces a fuller engine torque curve and optimizes the preparation of the mixture so that the pollutants in the exhaust gas are reduced.

The object of the adjuster is to adjust the beginning and the end of the valve stroke from "late" to "early" and vice versa by means of the camshaft. This must be achievable over a large speed range of the engine. Preferably, the adjustment should be effected continuously and automatically. The advantages of correct adjustment are: more torque in the lower and middle speed range, less uncombusted residual gases during idling, improved idling, lower pollutant output, internal exhaust gas recycling even at low speed, faster heating up of the catalyst and less raw emission after a cold start, specific functions for adapting the mixture during warm running, reduced fuel consumption and less engine noise.

The invention relates in particular to adjusters which are hydraulically actuated. If required, the adjuster is fed by an additional hydraulic pump. Preferably, however, feeding by the lubricating oil pump of the engine should be sufficient, this being particularly economical and favourable in terms of consumption.

As a result of the valve actuation, the camshaft experiences large torque variations, which the transmission device must withstand. A preferred adjuster should be capable of setting and maintaining any desirable angular adjustment in a sufficiently short time, independently of the respective torque acting on the camshaft. For this purpose, its working capacity or its adjusting capacity must be correspondingly large. In the case of feeding by the lubricating oil pump, problems occur at high oil temperature and also at low speed of the engine and hence of the pump, owing to the low oil pressure available. A high adjusting speed is desired. The required feed pressure and/or feed flow rate should be as low as possible. At the same time, the dimensions should be so small that no further design modifications on the engine are required. Preferably, the adjuster should be located radially inside the camshaft wheel and should be axially short.

A known adjuster uses an axially acting hydraulic piston for axial adjustment of a sleeve. The sleeve comprises an inner and an outer spiral gear, the two gears being formed with opposite pitches. The outer gear of the sleeve engages an inner gear firmly connected to the camshaft wheel, and the inner gear of the sleeve engages a gear connected to the camshaft. As a result of an axial adjustment of the sleeve, an angular adjustment is achieved between the camshaft wheel and the camshaft. Owing to the limited axial length, the adjustment range is limited. If the spiral angle is increased, the working piston must be enlarged in the case of an identical transmittable adjusting moment, which in turn leads to a larger piston diameter. Furthermore, the inevitable tooth play thus becomes more effective, which, owing to the periodically changing torques of the camshaft, leads to undesired noises and to increased wear. The oil actuating the hydraulic piston can flow in the wrong direction during torque peaks, particularly if, at low engine speed, the actuating oil pressure is lower than the compression pressure generated by the camshaft torque. In this way, the speed of adjustment and the accuracy of positioning are reduced. If this is to be avoided, the oil pump must be dimensioned substantially larger. Particularly at high engine speeds, this leads to higher energy losses. A further disadvantage of opposite spiral gears is their complicated production.

A further known adjuster is in the form of a so-called wing adjuster. An outer housing part is firmly connected to the camshaft wheel and comprises regions which project radially inward and divide an annular space into compartments. Wings project radially outward, each in a compartment, from a shaft part fastened to the camshaft. These wings rest tightly against the compartment border, laterally and radially on the outside, so that a rotary piston system is formed. By feeding oil to one side of all wings and discharging oil on the other side of all wings, it is possible to achieve a rotation of the outer housing part relative to the shaft part. By integration of the product of radius and operating pressure over the wing areas, a transmission and adjustment torque is determined. The more wings arranged on the circumference, the higher is the torque generated at a given oil pressure. At the same time, however, the maximum adjustment angle decreases in the case of a larger number of wings, because in fact the construction space in the circumferential direction is limited.

On starting the engine and possibly also at a high oil temperature, the oil pressure of the lubricating oil pump is too low to produce in the adjuster a torque which is greater than the maximum camshaft torques. The peaks of the camshaft torques adjust the rotational position of the adjuster until the wings rest against a compartment border. Because the camshaft torques oscillate between positive and negative maxima, the adjuster is deflected, at excessively low oil pressure, away from a desired rotational position alternately in the two directions of rotation until the wings make contact. This leads to considerable wear and to unpleasant noises. This undesired effect is reduced by using, for example, a brake element which damps the oscillating movements at low oil pressure.

For adjusting and maintaining the rotational position, an oil supply valve, a rotational position detector and a control are formed in such a way that deviations from a setpoint position are corrected by a corresponding valve actuation. The required oil pressure and correspondingly also the oil consumption of this rotary piston adjuster resulting from leakage are high because the full pressure is required also for maintaining a set rotational position or for transmitting the camshaft torques. Depending on the maximum camshaft torques occurring in both directions of rotation, high peak values occur in the working areas of the rotary piston system. If the oil supply valve is closed, these high compression pressures are troublesome only because correspondingly high leakage losses occur. When the adjusting valve is opened in the adjusting phase, the oil can flow in the wrong direction during torque peaks, because, particularly at low engine speed, the actuating oil pressure is lower than the compression pressure. In this way, the speed of adjustment and the accuracy of positioning are reduced so that, in such engines, the oil pump has to be dimensioned substantially larger. Particularly in the case of high engine speeds, this leads to higher energy losses.

It is the object of the invention to provide an adjuster which makes it possible to make any desirable angular adjustment even in the case of torques acting on the shaft, in particular in the case of the torque variation transmitted from the valves to the camshaft. Its working capacity and its adjusting capacity should be as large as possible even at low actuating fluid pressure. At the same time, the construction dimensions should be small and the production cost low.

This object is achieved by the features of claim 1. The dependent Claims describe alternative or advantageous embodiments.

In achieving the object, it was recognized that a hydrostatic rotary piston machine based on the orbit principle makes it possible to achieve the required adjusting capacity even at a low actuating oil pressure. Such machines comprise at least one stator, a rotor or rotary piston, a driven part and a valve device which connects rotating regions of the working area between stator and rotor to high and low pressure. Preferably, the number of teeth of the inner gear of the stator is one greater than that of the outer gear of the rotary piston. The individual components of a rotary piston machine can be produced at low cost, in particular by means of sintering. The annular machine parts and the working area require only little space. An adjuster according to the invention is preferably arranged directly between the camshaft and the camshaft wheel, the camshaft wheel in particular being formed directly on the stator so that only an extremely small additional construction space is required.

A further advantage is that any desired rotational position change or rotation between a shaft and a shaft wheel located thereon can be achieved. By forming the rotational position adjuster as a rotary piston machine or hydraulic motor having two annular rotational connections for feeding and removing hydraulic fluid, it can perform a drive function in other applications in addition to the adjusting function required, for example, in the case of camshafts. This means that the adjuster according to the invention can be used both as an orientation or positioning unit and as a movement unit on rotating shafts. In the most general case, the rotational position or rotary speed of the transmission wheel is changed relative to the shaft with hydraulic fluid which can be fed and removed via two annular rotational connections, for adjusting the phase position and/or the rotary speed of a shaft which can be caused to rotate by a drive shaft via a transmission device having at least one transmission wheel located on a shaft. For actuation, a fluid supply device comprising a control, a rotational position or rotary speed detector and at least one control valve is used, so that a setpoint rotational position or speed or acceleration can be set by a corresponding valve actuation.

If only the phase position of a camshaft is to be adjusted within a predetermined angular range, in particular a sufficiently large drive torque is required even in the case of low fluid or oil pressure. A rotary piston machine in which the transmission of rotation from the rotary piston to the driven part is effected with a speed ratio of 1:1 is preferably provided. The valve device of the rotary piston machine then preferably comprises first and second, radial valve channels which rotate with the driven part, in particular are formed thereon, are distributed uniformly over the circumference and cooperate with inner connection regions of radial stator channels distributed uniformly over the circumference. The outer connection regions of the stator channels open into the working area between the teeth of the inner gear of the stator. The number of first or second valve channels differs from the number of stator channels by one channel in each case, so that the inner connection regions of the stator channels are connected to first valve channels in a first circumferential segment and to second valve channels in a second circumferential segment. The first valve channels are connected via an inner annular channel in the driven part to one annular rotational connection, and the second valve channels are connected via a space between the driven part and the rotary piston and an outer connecting channel in the driven part to the other annular rotational connection.

To achieve a speed ratio of 1:1 between the rotary piston and the driven part, a force must be transmitted between the rotary piston, rotating eccentrically about the axis of the driven part, and the driven part. According to CH 676 490, the force or torque transmission can be effected, for example, by means of a cardan shaft. However, this would lead to a large construction length in the axial direction. A further transmission device mentioned in CH 676 490 comprises coupling by means of bolts which are held in matching holes in one part and, in the other part, in holes having diameters which are larger than the bolt diameters by twice the eccentricity. During the rotational transmission, the bolts roll along the border surfaces of the larger holes. This bolt transmission, too, leads to a greater construction length in the axial direction. A solution preferred owing to the short construction length and according to CH 676 490 comprises an inner gear on the rotary piston and an outer gear on the driven part. To ensure that the axis of rotation of a driven part driven by the rotary piston can be stationary, cooperating teeth are provided with tooth contours which are adapted to the existing eccentricity.

It has now been found that, on rotational transmission between rotary piston and driven part having an inner and an outer gear, a self-locking effect is achieved between the stator and the driven part. This means that a torque applied to the driven part is transmitted via the rotary piston to the stator. Because the rotary piston cannot be caused to rotate in practice, this is an essentially interlocking torque transmission which can be further increased by approximating the tooth contour to a triangular shape. The adjuster can thus be adjusted in its rotary angle position only by supplying oil pressure, but not by applying torque externally. It is thus ensured that high torque peaks of the camshaft cannot lead to high compression pressures in the working chambers of the hydraulic system and that no supporting pressure for torque transmission is required for normal operation, i.e. if no angular adjustment takes place. During the adjustment-free phases, essentially no oil leakage flows occur, which leads to a low mean oil throughput. Moreover, a reservoir could be filled with hydraulic oil during the adjustment-free phases, which is then available in adjustment phases. Consequently, the amount of hydraulic oil required by the oil pressure pump would be reduced, which reduces the requirements with respect to the pump and accordingly with respect to its power dissipation.

For adjusting the camshaft phase position, the adjuster is preferably arranged on the camshaft, but optionally on the drive shaft or on an additional transmission shaft.

The preferred adjusters operate according to the orbit principle of the high-torque hydraulic engines known in high-pressure hydraulics. This results in an extremely high working capacity. The rotational position adjustment is effected continuously and has no angular limitation. Because of the tooth shapes fitting one into the other and the self-locking produced in the preferred embodiments, no impact noises occur. In addition, the adjusters according to the invention are simple to produce and require only a few parts.

The embodiment mentioned above and described below with reference to the example and having a drive part which is rotatable at the speed of the rotary piston about a fixed axis and in particular comprises a control part of the valve device is a solution which can also be used as an advantageous, low-speed hydromotor. Of course, such a low-speed hydromotor can also be formed with a fixed driven part and rotating stator. It would then be possible to dispense with rotational connections. Low-speed hydromotors, in particular arranged on shafts, can advantageously be used, for example, as drives in machine tools.

BRIEF DESCRIPTION OF THE DRAWING

The drawings illustrate the invention with reference to an embodiment.

DETAILED DESCRIPTION OF THE PREFERRED EMBODIMENT

Figure 1:
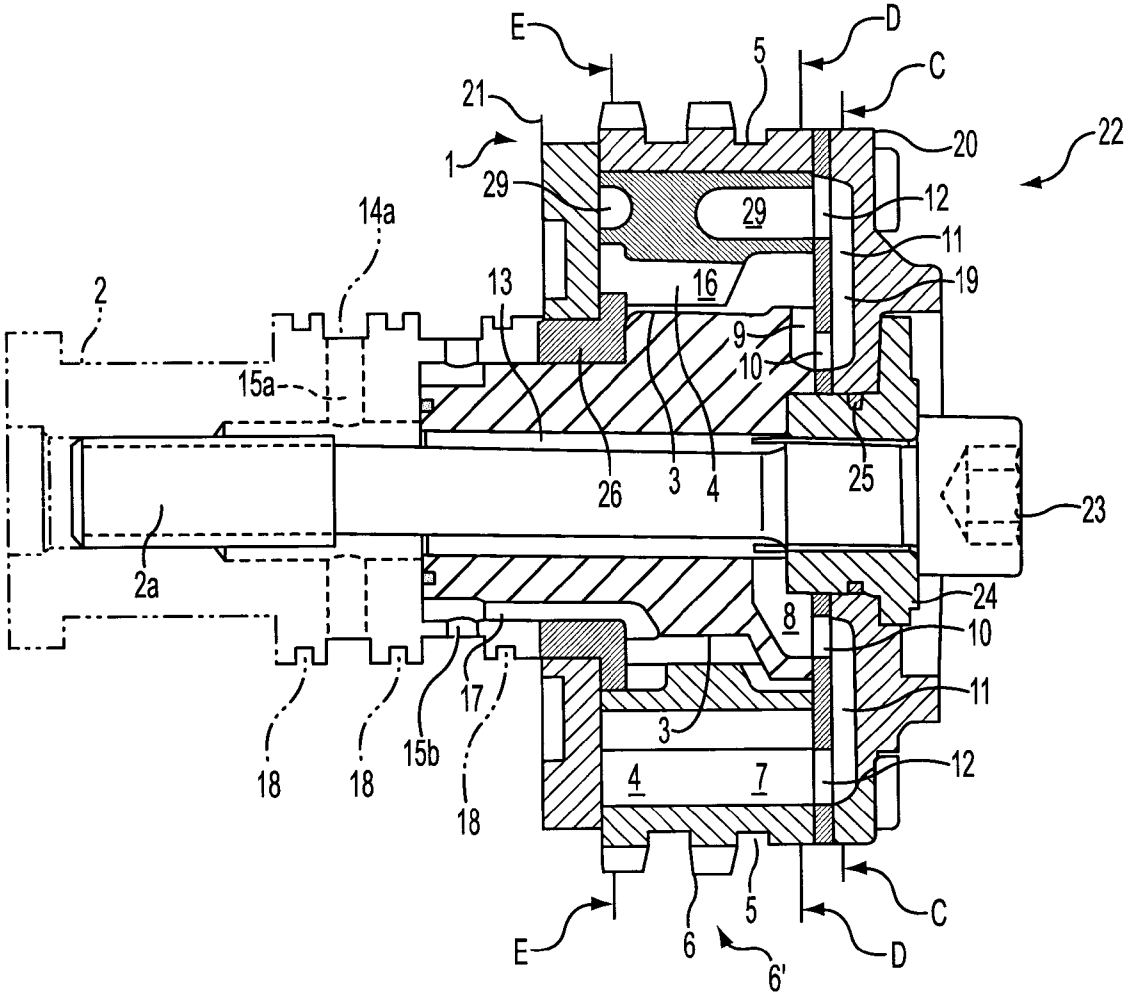
FIG. 1 shows a vertical section along the camshaft axis, through an adjuster fastened on the camshaft.
Figure 2:
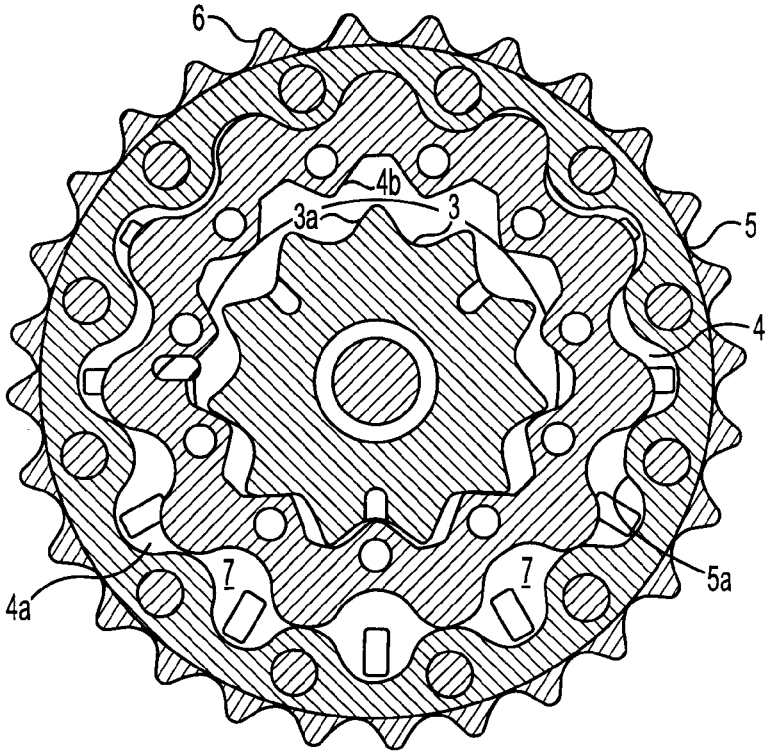
FIG. 2 shows a vertical section E—E according to FIG. 1.

FIG. 1 shows an adjuster 1 which is arranged at a free end of a camshaft 2. The adjuster 1 is in the form of a rotary piston machine and comprises at least one driven part 3, a rotary piston 4 and a stator 5. An outer gear of the stator 5 forms the camshaft wheel 6', which optionally also could be fastened as a separate part on the stator 5. As a result of a rotary movement of the rotary piston 4 about an eccentric axis rotating about the camshaft axis 2*a*, a rotation is achieved between stator 5 and driven part 3. In order to drive this rotary movement of the rotary piston, hydraulic fluid or oil under pressure must be fed to a part of working chambers 7 between the stator 5 and the rotary piston 4 in a controlled manner and fluid allowed to flow away out of another part of working chambers 7. According to FIG. 2, the working chambers 7 form between a stator inner gear 5*a* and a rotary piston outer gear 4*a*. Preferably, the number of teeth of the stator inner gear 5*a* is twelve and that of the rotary piston outer gear 4*a* is eleven. The rotary movement of the rotary piston is produced by the expansion of the working chambers 7 of one half of the circumference, due to the fluid feed, and the corresponding reduction in size of the working chambers 7 of the other half of the circumference. In order to control the fluid feed, or to connect the working chambers 7 rotationally to a high or low pressure, so that the desired rotary piston movement is produced, a valve device is provided.

Figure 3:
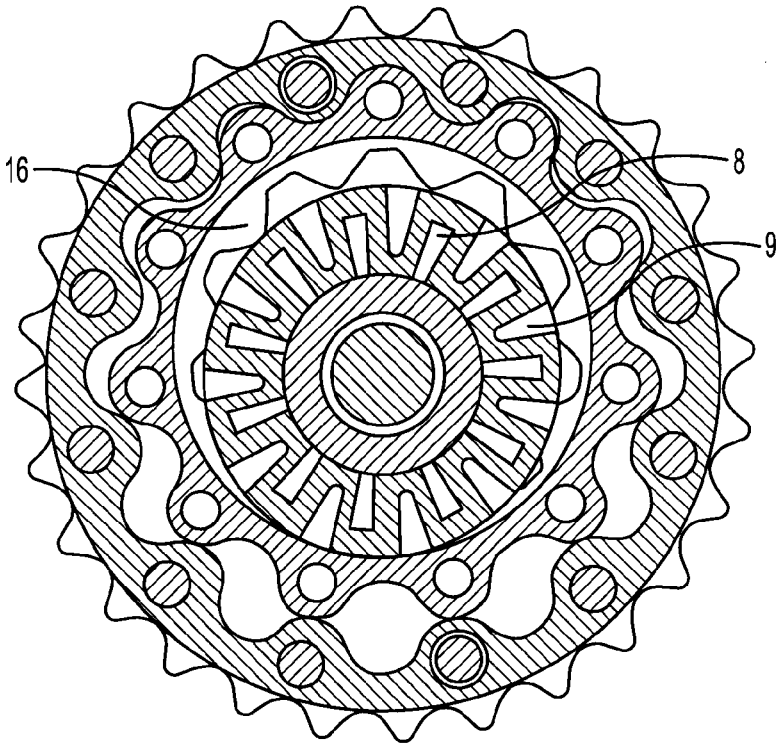
FIG. 3 shows a vertical section D—D according to FIG. 1.
Figure 4:
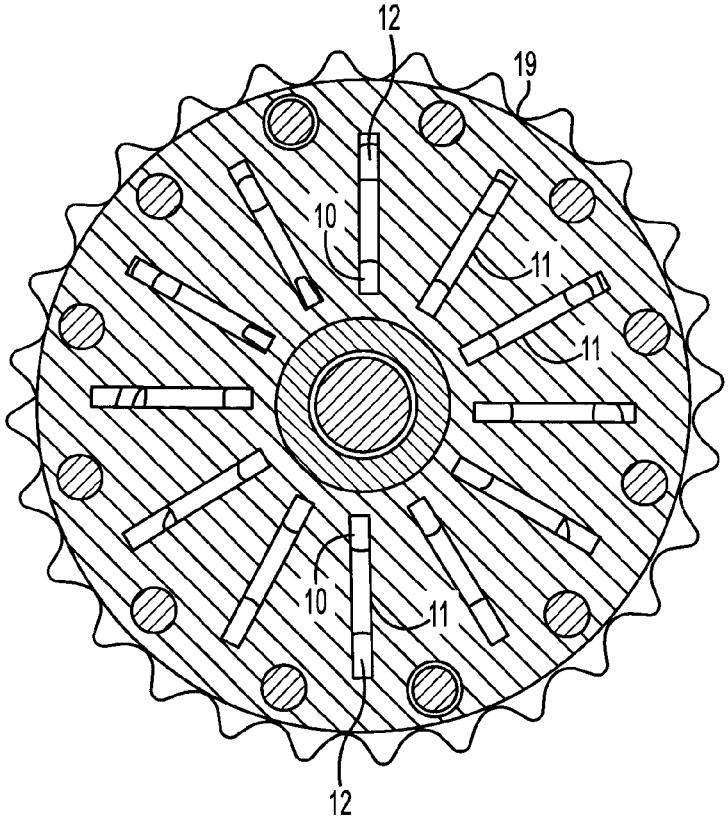
FIG. 4 shows a vertical section C—C according FIG. 1.
Figure 5:
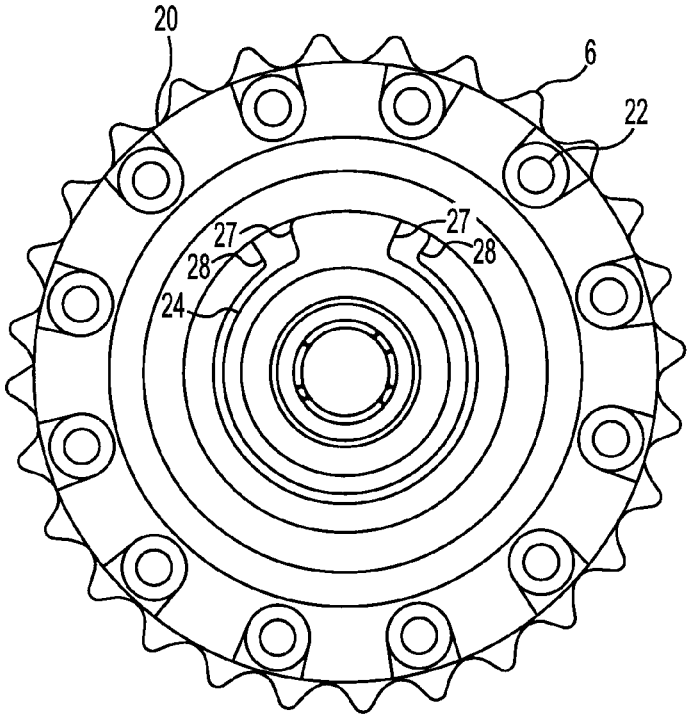
FIG. 5 shows a view of the camshaft end with the adjuster.

The valve device comprises a channel system rotating at the speed of the rotary piston 4 (FIG. 3) and firmly connected to the stator 5 (FIG. 4). Because the rotating channel system of the embodiment shown is formed on the driven part 3, according to FIG. 2 the driven part 3 is caused to rotate preferably by the cooperation of an output outer gear 3*a* and a rotary piston gear 4*b*. The transmission of rotation from the rotary piston 4 to the driven part 3 is effected with the speed ratio 1:1, for which purpose the number of teeth of the output outer gear 3*a* corresponds to that of the rotary piston inner gear 4*b*. In addition, in the embodiment shown, the number of teeth of the rotary piston outer gear 4*a* is also the same as that of the rotary piston inner gear 4*b*. The valve device comprises first 8 and second 9, radial valve channels which rotate with the driven part 3, are preferably formed thereon, are distributed uniformly over the circumference and cooperate with inner connection regions 10 of the radial stator channels 11 which are uniformly distributed over the circumference and whose outer connection regions 12 open into the working chambers, between the teeth of the inner gear 5*a* of the stators. The number of first or second valve channels 8, 9 differs from the number of stator channels 11 in each case by one channel, so that the inner connection regions 10 of the stator channels 11 are connected, in a first circumferential segment, to first valve channels 8 and, in a second circumferential segment, to second valve channels 9. The inner and outer connection regions 10 and 12 of the stator channels 11 are in the form of holes through a plate cam 19 firmly connected to the stator 5. The stator channels 11 are preferably in the form of depressions in the outer stator cover 20.

The first valve channels 8 are connected via an inner annular channel 13 in the driven part 3 and in the camshaft 2, and at least one first radial hole 15*a*, to an annular first rotational connection 14*a*. The second valve channels 9 are connected via a space 16 between the driven part 3 and the rotary piston 4, an outer connecting channel 17 in the driven part 3 and a radial hole 15*b* in the camshaft 2 to a second annular rotational connection 14*b*. Annular grooves 18 for receiving sealing elements are formed in the axial direction on both sides of the rotational connections 14*a* and 14*b*.

The stator housing comprises the outer stator cover 20, the plate cam 19, the stator 5 and an inner stator cover 21. The stator housing is held together by screws 22. In the axial direction, the rotary piston 4 is in sliding contact with the inner surfaces of the plate cam 19 and of the inner stator cover 21. The stator housing is held rotatably on the driven part 3 in the axial direction. The driven part 3 is nonrotatably connected to the camshaft 2, an axially arranged screw part 23 screwed to the camshaft 2 preferably extending through a driven end part 24 and the driven part 3. The inner annular channel 13 is formed between the screw part 23 and the driven part 3. The stator housing is rotatably held in an annular groove between the driven end part 24 and the driven part 3 and is sealed from the outside by means of a sealing unit 25. A guide ring 26 is inserted between the driven part and the camshaft end in order to form a rotational guide or seal for the inner stator cover 21.

For applications in which the adjustment of the rotational position is limited to a predetermined angular range, a rotational range limiting means is formed, preferably between the driven end part 24 and the outer stator cover 20.

Such limiting means comprises, for example, two end part stop surfaces 27 which project radially outward and with each of which a stator stop surface 28 is coordinated so that the adjustment is possible only within a predetermined rotary angle range. By arranging the rotational range limiting means near the outer stator cover 20, the rotational position of the camshaft 2 is evident from a simple visual inspection.

The stator 5 having the inner gear and/or the rotary piston 4 and/or the driven part 3 and/or the stator cover 20, 21 are preferably produced by the powder metallurgical process. If necessary, a rotary piston 4 made of plastic is used. To reduce the weight, axial cavities 29 may be formed in the rotary piston 4.

What is claimed is:

1. An adjusting device (1) for adjusting the phase position of a shaft, which is a camshaft (2), which is caused to rotate by a drive shaft, which is a crankshaft, via a transmission device having at least one transmission wheel (6') located on a shaft, the adjusting device making it possible to adjust the rotational position of the transmission wheel (6') relative to the shaft (2) by means of hydraulic fluid which can be fed in and removed via two annular rotational connections (14*a*, 14*b*) and a fluid supply device comprising a control, a rotational position detector and at least one control valve making it possible to set a setpoint rotational position by a corresponding valve actuation, wherein the adjusting device (1) is a rotary piston machine based on the orbit principle, which comprises a stator (5) having an inner gear (5*a*), an annular rotary piston (4) having an outer gear (4*a*) engaging the inner gear of the stator (5*a*), a driven part (3) which can be caused to rotate by the rotary piston (4) and a valve device (8–12), which, for controlling the rotary piston movement, makes it possible to connect rotating regions of the working area (7) between stator (5) and rotary piston (4) to high or low pressure of the fluid supply device.

2. The adjusting device (1) as claimed in claim 1, wherein the number of teeth of the inner gear of the stator (5*a*) is greater by one than that of the outer gear of the rotary piston (4*a*).

3. The adjusting device as claimed in claim 1, wherein the transmission of rotation from the rotary piston (4) to the driven part (3) is effected with the speed ratio 1:1 and the valve device (8–12) comprises first and second, radial valve channels (8, 9) which rotate with the drive part (3), are formed thereon, are uniformly distributed over the circumference and cooperate with inner connection regions (10) of radial stator channels (11) which are uniformly distributed over the circumference and whose outer connection regions (12) open into the working area (7), between the teeth of the inner gear of the stator (5*a*), the number of first or second valve channels (8, 9) differing from the number of stator channels (11) by one channel in each case, so that the inner connection regions (10) of the stator channels (11) are connected in a first circumferential segment, to first valve channels (8) and, in a second circumferential segment, to second valve channels (9).

4. The valve device as claimed in claim 3, wherein the first valve channels (8) connect via an inner annular channel (13) in the driven part (3) to one annular rotational connection (14*b*) and the second valve channels (9) connect via a space (16) between the driven part (3) and the rotary piston (4) and an outer connecting channel (17) in the driven part (3) to the other annular rotational connection (14*a*).

5. The adjusting device as claimed in claim 3, wherein the inner and outer connection regions (10, 12) of the stator channels (11) are formed in a plate cam (19) firmly connected to the stator (5) and the stator channels (11) are preferably formed as depressions in a stator cover (20).

6. The adjusting device as claimed in claim 1, wherein an outer gear of the driven part (3*a*) engages an inner gear of the rotary piston (4*b*), the number of teeth and/or the tooth shapes being chosen so that the rotational connection between the driven part (3) and the stator (5) is self-locking, so that each rotational position is essentially held in an interlocking manner even in the absence of hydraulic fluid and at high torques between the stator (5) and the driven part (3).

7. The adjusting device as claimed in claim 6, wherein the two gears of the rotary piston (4*a*, 4*b*) have identical numbers of teeth, this number of teeth being eleven and the number of teeth for the inner gear of the stator (5*a*) being twelve.

8. The adjusting device as claimed in claim 1, wherein axial cavities (29) are formed in the rotary piston (5) for reducing the weight.

9. The adjusting device as claimed in claim 1, wherein the stator part having the inner gear (5*a*) and/or a rotary piston (4) and/or the driven part (3) and/or a stator cover (20, 21) are produced by the powder metallurgical process.

10. The adjusting device as claimed in claim 1, wherein the rotary piston (4) is produced from plastic.

11. The adjusting device as claimed in claim 1, wherein the driven part (3) is nonrotatably connected to the camshaft (2), an axially arranged screw part (23) screwed to the camshaft (2) extending through a driven end part (24) and the driven part (3), the stator (5) being held in an annular groove between the driven end part (24) and the driven part (3) and consisting of four parts held together by means of screws, namely a first and a second stator cover (20, 21), a plate cam (19) and a gear part (5).

12. The adjusting device as claimed in claim 11, wherein a rotational range limiting means is formed between the driven end part (24) and the stator cover (20), in the form of two end part stop surfaces (27) which project radially outward and with each of which a stator stop surface (28) is coordinated so that the adjustment is possible only within a predetermined rotary angle range.

13. The adjusting device as claimed in claim 1, wherein the transmission wheel (6') is fastened on the stator (5), is formed directly thereon, the transmission wheel (6') comprising a chain gear or toothed-belt gear.

* * * * *